US005833069A

United States Patent [19]

Jones

[11] Patent Number: 5,833,069

[45] Date of Patent: Nov. 10, 1998

[54] INFLATABLE PROTECTIVE CONTAINER FOR BOTTLES AND THE LIKE

[76] Inventor: David G. Jones, 250 SW. 112th Ter., Pembroke Pines, Fla. 33025

[21] Appl. No.: 696,653

[22] Filed: Aug. 14, 1996

[51] Int. Cl.[6] ..... B65D 1/02

[52] U.S. Cl. ..... 206/522; 383/3; 220/903

[58] Field of Search ..... 206/427, 522; 383/3, 63; 220/737, 739, 903

[56] References Cited

U.S. PATENT DOCUMENTS

| | | | |
|---|---|---|---|
| 2,729,259 | 1/1956 | Abrams | 206/522 |
| 3,578,199 | 5/1971 | Duncan | 220/739 |
| 4,085,785 | 4/1978 | Hoot | 206/522 |
| 4,197,890 | 4/1980 | Simko | 220/903 |
| 4,574,953 | 3/1986 | Garbuzov | 206/522 |
| 4,809,352 | 2/1989 | Walker | 206/522 |
| 5,217,131 | 6/1993 | Andrews | 206/522 |
| 5,261,554 | 11/1993 | Forbes | 220/739 |
| 5,447,010 | 9/1995 | Voigt | 383/3 |
| 5,562,592 | 10/1996 | Curiel | 206/522 |

*Primary Examiner*—David T. Fidei
*Attorney, Agent, or Firm*—Malin, Haley, DiMaggio & Crosby, P.A.

[57] ABSTRACT

An inflatable container for housing fragile articles, such as bottles and the like, for protecting the enclosed article from breakage during shipping or transit. The container comprises a generally cylindrical inflatable housing shaped to conform to a specific bottle shape and having an inflation device for enabling user inflation. The housing has an open bottom end for receiving a bottle type article therein. An inflatable base is sized for mating engagement with said bottom end thereby covering said opening. A fastening apparatus is provided for securing the base to the housing, and a seal is provided between said housing bottom and said base thereby forming a hermetic seal for preventing escape of any solid, liquid, or vapor contents enclosed within the housing in the event of breakage.

7 Claims, 4 Drawing Sheets

INFLATABLE PROTECTIVE CONTAINER FOR BOTTLES AND THE LIKE

BACKGROUND OF THE INVENTION

1. Field of the Invention

This invention relates to impact absorbing packaging, and more particularly to inflatable packaging for protecting fragile articles, such as bottles, from damage during shipping or transport.

2. Description of the Prior Art

There exists a well known problem in the transportation and packaging industries involving the breakage of relatively fragile articles, such as bottles and glass, during transport or shipping. For example, travelers often pack fragile items such as liquor bottles, perfume, or other glass containers, in luggage for transport on various forms of mass transportation, such as airlines, trains, and busses. It is therefore, not uncommon that these fragile items experience breakage resulting from handling and transport. Such breakage is particularly undesirable when the fragile container is a liquor bottle packed in a suitcase with other, often valuable personal items and clothing. In addition, these fragile containers often contain expensive perfumes which makes breakage not only undesirable, but also costly.

Accordingly, the prior art includes various types of rugged suitcases and luggage designed to provide adequate protection for fragile articles stored therein. Typically, these rugged suitcases comprise "hard" shell designs which are inherently relatively heavy, and, thus, difficult to handle, particularly for older travelers or those suffering from physical disabilities. Furthermore, these "hard" shell designs fail to protect the enclosed contents from breakage resulting from internal movement and contact.

The breakage problem is magnified by the fact that the majority of luggage in use today comprises "soft" shell designs and duffel bags. In addition, travelers often pack liquor and perfume containers in carry-on bags which must often be checked in transit when the traveler transfers over to a small plane as is typical of commuter airlines thereby subjecting the contents to breakage. Therefore, these "soft" shell designs, duffel bags, and carry-on bags, generally fail to provide any significant protection for articles contained therein for transporting fragile articles on mass transportation systems.

The aforementioned problems with transporting fragile articles has been addressed, with limited success, by the prior art. For example, U.S. Pat. Nos. 4,597,244 and 5,487,470 each issued to Pharo, and 4,620,633, issued to Lookholder, disclose inflatable packaging methods and devices for protecting fragile articles. U.S. Pat. Nos. 4,569,082, issued to Aisnworth et al., 4,801,213, issued to Frey et al., and 4,905,835, issued to Pivert et al., each disclose inflatable luggage or packaging inserts for protecting certain articles. Finally, U.S. Pat. Nos. 4,190,158 issued to Ambrose, and 4,240,556, issued to Field, disclose inflatable containers for delicate articles.

These prior art devices, however, disclose complicated structures not well suited for use in transit by the individual traveler. For example, many of the devices are bulky and not suitable for use with a small carry-on bag. In addition, many of the devices contemplate the use of specialized inflation and sealing equipment, and are thus not adaptable for convenient and repeated use. In addition, the disclosed prior art devices are costly to fabricate. Finally, none of the prior art devices disclose a structure particularly suited for protecting a single bottle and the like. Accordingly, none of the prior art devices have gained widespread acceptance or are in widespread use.

Thus, there exists a need for an inflatable articles container that is relatively small, simple, and easy to use, and further which is particularly suited for housing bottles and the like. Such a device must be user inflatable and shaped for receiving a particular bottle shape therein for protecting the enclosed article from breakage.

SUMMARY OF THE INVENTION

The present invention contemplates an inflatable container for housing fragile articles, such as bottles and the like, for protecting the enclosed article from breakage during shipping or transit. The invention comprises a generally cylindrical inflatable housing shaped to conform to a specific bottle shape and having an inflation means for enabling user inflation and deflation. When not in use, the device is capable of complete deflation thereby collapsing for compact storage.

In the preferred embodiment the device includes a double wall structure which assumes a bottle shape defining a cavity when inflated for housing a liquor or wine bottle snugly therein. The device includes a bottom portion defining an opening for inserting the bottle therein and an inflatable base hingedly attached thereto, for mating attachment with the main structure for closing the housing and thereby sealing the enclosed bottle within the housing and providing an air cushioned housing completely surrounding the bottle. In the preferred embodiment, the bottom portion and base portion incorporate means for sealing to form a hermetic or water-tight seal thereby preventing leakage of the enclosed contents should breakage occur. A user sealable means for inflating the device is associated therewith for enabling the user to selectively inflate and deflate the device as necessary.

Accordingly, there is provided a lightweight device which, when deflated, is compact and easily stored and transported and which the user may quickly and easily inflate, insert a bottle therein, and, by attachment of the base portion, completely seal the bottle therein such that the bottle is protected on all sides by a cushion of air and maintained in a hermetic container. In addition, there may be a handle or carrying strap associated with the device whereby the user may hand carry any fragile article therein such that the article is protected from inadvertent contact with other objects.

It is an object of the present invention to provide an inflatable articles container for protecting fragile articles, such as bottles, from damage during shipping.

Yet another object of the present invention is to provide an inflatable container for housing liquor and wine bottles, which container conforms to the shape of the enclosed bottle.

Still another object of the present invention is to provide an inflatable articles container for enclosing a bottle in a water-tight housing.

In accordance with these and other objects which will become apparent hereinafter, the instant invention will now be described with particular reference to the accompanying drawings.

DESCRIPTION OF THE PREFERRED EMBODIMENTS

Figure 1:
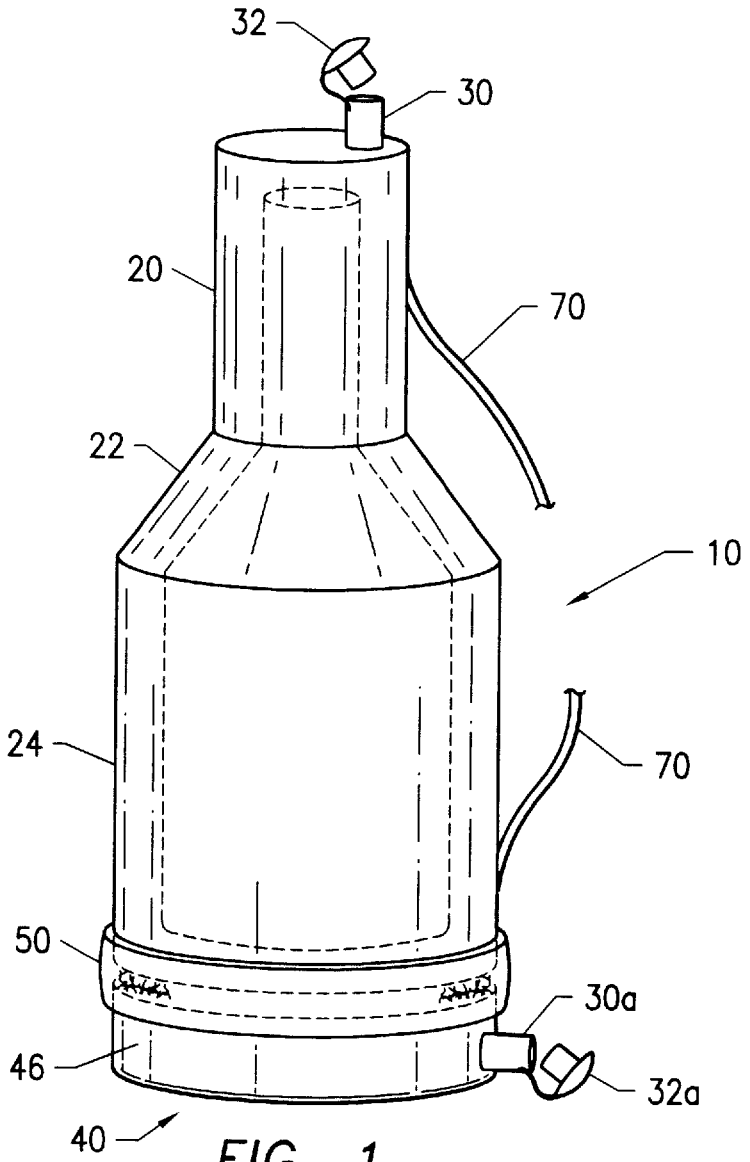
FIG. 1 is a perspective view of the present invention having a bottle shown therein in phantom.
Figure 2:
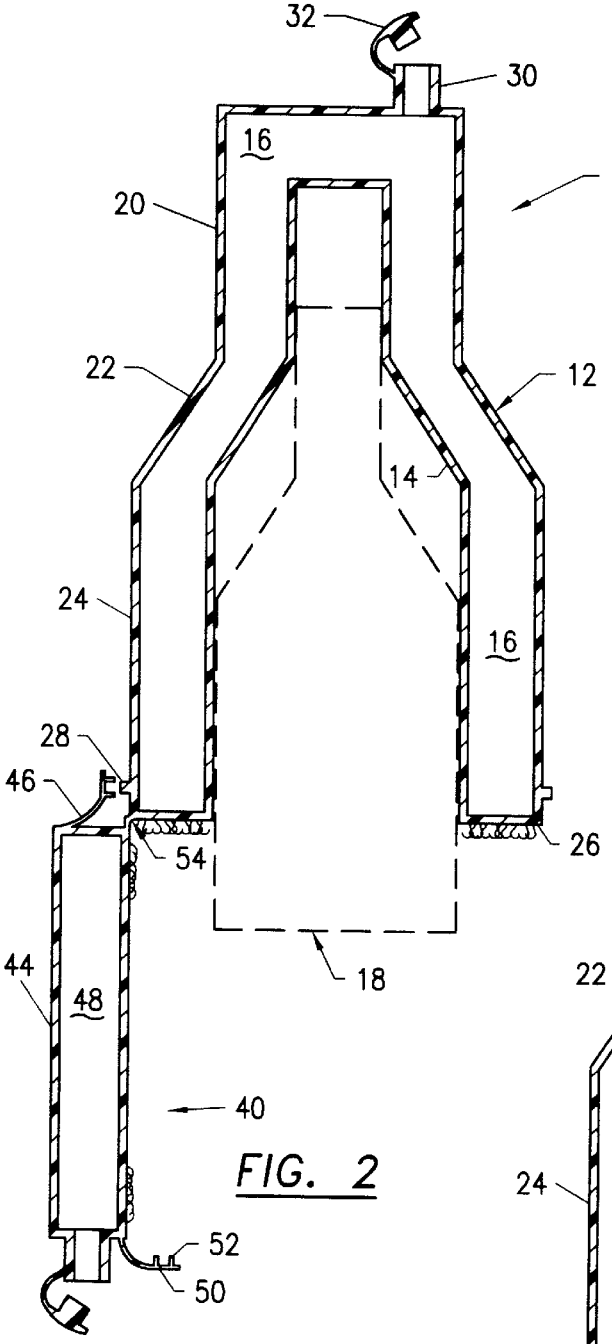
FIG. 2 is a cross sectional view of the present invention having a bottle shown in phantom partially inserted therein.

Turning now to the FIGS. 1–5 there is depicted a preferred embodiment of the present invention. FIG. 1 shows a perspective view of the present invention, generally referenced as 10. FIG. 2 shows a cross sectional view of the invention with a bottle shown in phantom. The invention comprises an inflatable housing, generally referenced as 10, having an outer wall, generally 12, and an inner wall 14. Walls 12 and 14 are preferably fabricated from light weight plastic, however, any suitable air-tight material is considered within the scope of the invention. Walls 12 and 14 define an air chamber 16.

The device is shaped to include an a generally cylindrical top portion 20, a tapering mid-portion 22 and a generally cylindrical bottom portion 24. Bottom portion 24 defines an open end, generally referenced as 26, leading to a bottle shaped chamber defined by inner wall 14 for receiving therein a fragile bottle 18 (shown in phantom).

Housing 10 further includes an air valve means for inflation and deflation of the housing. In the preferred embodiment the means for inflation comprises an air valve 30 communicating with air chamber 16 for allowing the user to selectively inflate and deflate housing 10. Air valve 30 functions as a mouth piece and includes a cap 32 for sealing air chamber 16 in an air-tight manner. Housing 10 may also incorporate a carrying strap 70, as best depicted in FIG. 1.

Figure 3:
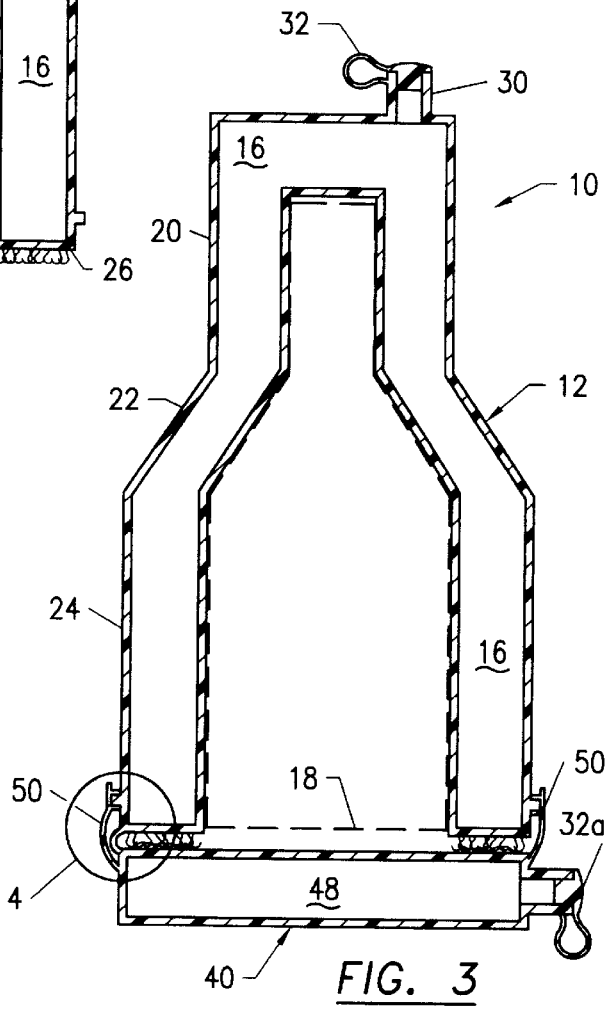
FIG. 3 is a cross sectional view of the present invention having a bottle shown therein in phantom.
Figure 4:
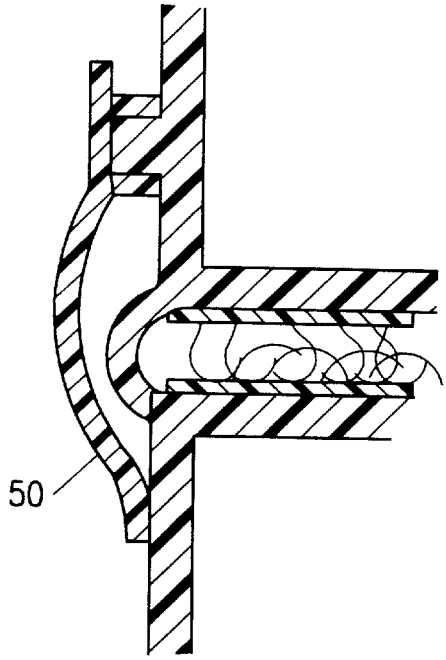
FIG. 4 is a detail showing the attachment of the base to the main structure and the sealing means.
Figure 5:
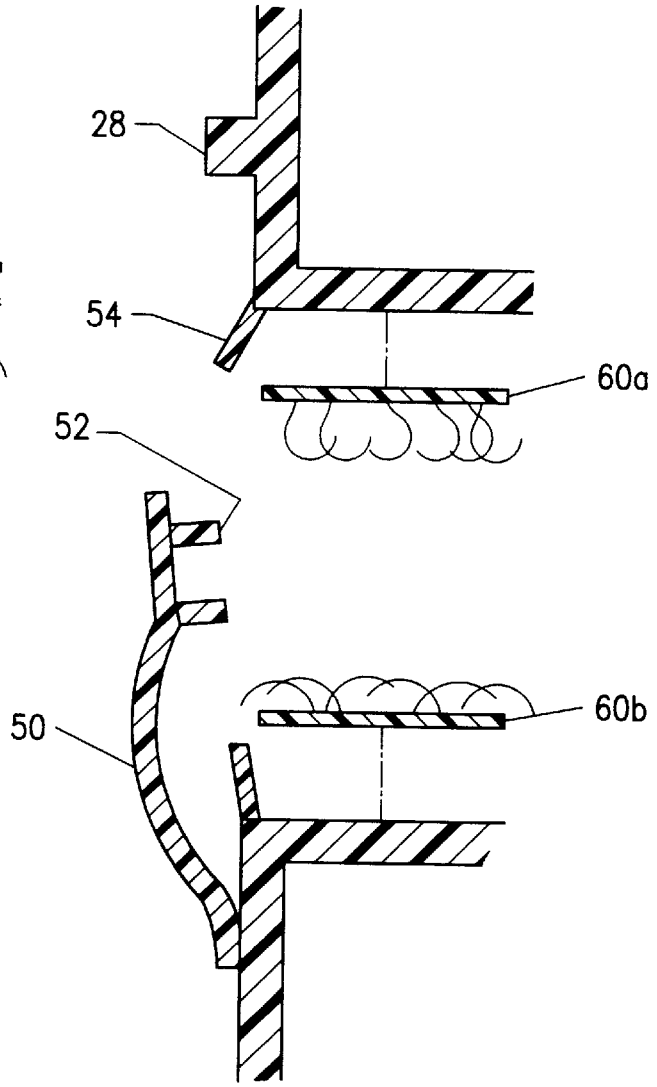
FIG. 5 is an exploded detail of FIG. 4.

An inflatable base, generally referenced as 40, includes top and bottom walls, 42 and 44 respectively, and a cylindrical side wall 46, which walls 42, 44, and 46, are joined to define air chamber 48. Side wall 46 includes an air valve 30*a* and cap 32*a* for allowing the user to selectively inflate and deflate base 40. Base 40 is sized for mating engagement with housing bottom portion 24 thereby covering open end 26 as best depicted in FIG. 1–3. Hook and loop fastening material, referenced as 60*a* and 60*b*, provides means for fastening base 40 to housing end 26. In the preferred embodiment, circular strips of hook and loop fastening material are mounted to housing end 26 and base top surface 42 for fastening engagement when base 40 exists in the "closed" position as depicted in FIGS. 1 and 3.

In addition, base 40 includes a cylindrical tab 50 having inwardly projecting members 52 for mating engagement with a cylindrical ring 28 existing on housing bottom portion 24 proximate end 26. Projecting members 52 and ring 28 cooperate in zip-lock fashion to form a hermetic/water-tight seal between base 40 and housing 10 thereby preventing leakage of any contents from within the housing should a substantial impact cause breakage of the enclosed container 18. Base 40 may be hingedly connected to housing 10 by any suitable hinge means 54.

Therefore, as best illustrated in FIGS. 1 and 2, housing 10 is inflated by the user by pumping air from the user's lungs through air valve 30 into chamber 16 until housing 10 is fully inflated and valve 30 is sealed by cap 32. Base 40, and specifically chamber 48 is inflated in a similar manner via air valve 30*a* and sealed upon full inflation by cap 32*a*. A bottle 18 such as a liquor or wine bottle, or any other fragile bottle-shaped article, is then inserted in housing 10 and received within the bottle-shaped chamber defined by inner wall 14 whereby the top and sides of the bottle are surrounded by cushioned air chamber 16. Base 40 is then mated with the housing open end 26 by placing base 40 substantially adjacent to housing end 26 such that hook and loop sections 60*a* and 60*b* fasten base 40 to housing end 26. In addition, a hermetic seal is created by the joinder of ring 28 and projecting members 52 whereby ring 28 is wedged between projecting members 52 thereby forming a circumferential seal. As is now apparent, bottle 18 is completely surrounded by a cushioned air chamber and maintained in a hermetically sealed housing which prevents any of the contents from escaping in the event of breakage.

Figure 6A:
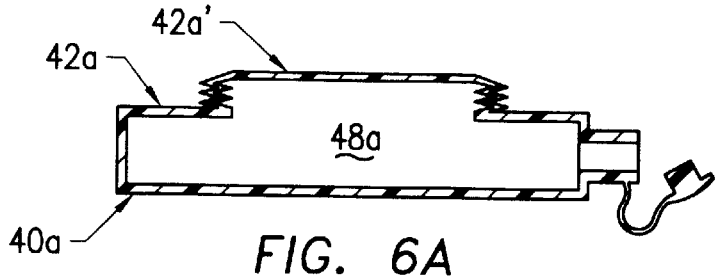
FIG. 6A is a sectional view of a deflated alternate base of the present invention.
Figure 6B:
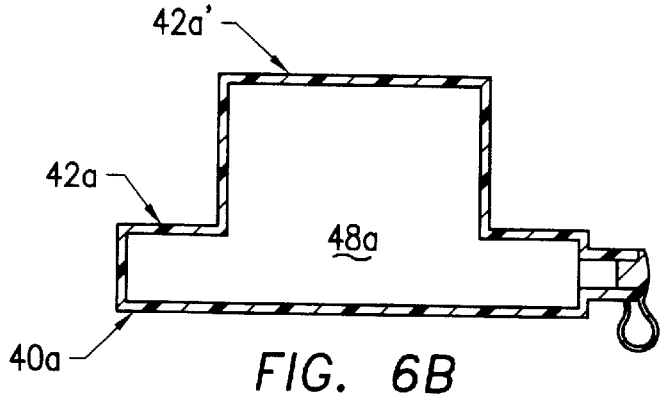
FIG. 6B is a sectional view of an inflated alternate base of the present invention.
Figure 7:
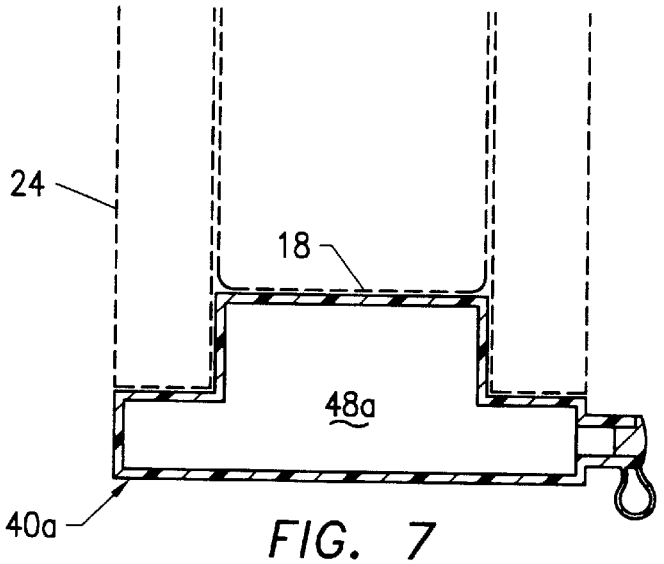
FIG. 7 is a partial sectional detail of the inflated alternate base with the main inflatable housing partially shown in phantom.

In an alternate embodiment, depicted in FIGS. 6A, 6B, and 7, base 40*a* includes a top wall 42*a* having an inflatable projecting portion 42*a*' in fluid communication with air chamber 48*a*. Projecting portion 42*a*' functions to expand into housing 10 upon inflation and bear against the bottom of bottle 18 thereby reducing the interior chamber volume for accommodating smaller sized bottles or the like securely therein.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An inflatable articles container comprising:

a housing having an inner wall and an outer wall, said inner and outer walls defining an air chamber, said inner wall defining an interior chamber, said housing having an end portion defining an opening leading to said chamber;

means for inflating said housing;

an inflatable base sized for covering said housing end opening;

means for inflating said base;

means for fastening said base to said housing whereby said base substantially covers said housing end opening; and, means for sealing said base with said housing end opening whereby a hermetic seal is formed therebetween, said means for sealing including a projecting ring existing on said housing outer wall proximate said housing end portion said ring extending annularly about said outer wall, and a generally cylindrical tab existing on said base, said tab having an inner surface including a pair of projecting members, said projecting members in spaced relation whereby said projecting ring is received between said projecting members thereby forming a hermetic seal.

2. An inflatable articles container according to claim 1, wherein said means for sealing comprises:

a projecting ring existing on said housing outer wall proximate said housing end portion said ring extending annularly about said outer wall;

a generally cylindrical tab existing on said base, said tab having an inner surface including a pair of projecting members, said projecting members in spaced relation whereby said projecting ring is received between said projecting members thereby forming a hermetic seal.

3. An inflatable articles container according to claim 1, wherein said means for fastening comprises hook and loop fastening material.

4. An inflatable articles container according to claim 1, wherein said means for inflating includes an air valve.

5. An inflatable articles container according to claim 1, wherein said base further includes an expandable top surface portion associated therewith.

6. An inflatable articles container comprising:

an inflatable housing having an inner wall and an outer wall, said inner and outer walls joined to define an air chamber, said inner wall further defining a bottle accommodating chamber, said housing having an end portion defining an opening leading to said chamber;

an air valve communicating with said housing air chamber thereby enabling selective inflation and deflation of said chamber;

an inflatable base hingedly connected to said housing proximate said housing end and sized for covering said housing end opening, said base defining a base air chamber;

an air valve communicating with said base air chamber thereby enabling selective inflation and deflation of said base air chamber;

said base, and said housing end, including hook and loop fastening material for fastening said base to said housing end whereby said base substantially covers said housing end opening;

means for hermetically sealing said base with said housing end opening;

said housing having a projecting ring existing on said housing outer wall proximate said housing end portion said ring extending annularly about said outer wall, and said base having a generally cylindrical tab associated therewith, said tab having an inner surface including a pair of projecting members, said projecting members in spaced relation whereby said projecting ring is received between said projecting members thereby forming a hermetic seal.

7. An inflatable articles container according to claim 6, wherein said base further includes a top wall having a collapsible projecting portion in fluid communication with said base air chamber, whereby inflation of said base causes expansion of said projecting portion.

* * * * *